US006278971B1

(12) United States Patent
Inoue et al.

(10) Patent No.: US 6,278,971 B1
(45) **Date of Patent: *Aug. 21, 2001**

(54) PHASE DETECTION APPARATUS AND METHOD AND AUDIO CODING APPARATUS AND METHOD

(75) Inventors: Akira Inoue, Tokyo; Masayuki Nishiguchi, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/236,868

(22) Filed: Jan. 26, 1999

(30) Foreign Application Priority Data

Jan. 30, 1998 (JP) ..... 10-019962

(51) Int. Cl.[7] ..... G10L 19/02; G10L 11/04

(52) U.S. Cl. ..... 704/205; 704/207; 704/265; 704/269

(58) Field of Search ..... 704/203, 205, 704/211, 265, 267, 269, 207

(56) References Cited

U.S. PATENT DOCUMENTS 5,504,833 4/1996 George et al. ..... 395/2.2
5,884,253 * 3/1999 Kleijn ..... 704/223
5,911,130 6/1999 Shimizu et al. ..... 704/500
5,987,413 * 11/1999 Dutoit et al. ..... 704/267
6,115,685 * 9/2000 Inoue et al. ..... 704/205

FOREIGN PATENT DOCUMENTS 0698876 2/1996 (EP) ..... G10L/7/06
08330971 12/1996 (EP) ..... H03M/7/30

OTHER PUBLICATIONS

Vocal system phase decoder for sinusoidal speech, S. Torres and F.J. Casajús–Quirós, Electroncis Letters, vol. 33, No. 20, pp. 1683–1685.

* cited by examiner

*Primary Examiner*—Tālivaldis Ivars Šmits
(74) *Attorney, Agent, or Firm*—Jay H. Maioli

(57) ABSTRACT

An apparatus and procedure for performing phase detection in which one-pitch cycle of an input signal waveform is cut out on a time axis. The cut-out one pitch cycle is filled with zeroes to form $2^N$ samples (where N is an integer, $2^N$ is equal to or greater than the number of samples of the one-pitch cycle), and the samples are subjected to an orthogonal conversion such as fast Fourier transform, whereby a real and imaginary part are used to calculate $\tan^{-1}$ to obtain a basic phase information. This basic phase is subjected to linear interpolation to obtain phases of respective higher harmonics of the input signal waveform.

18 Claims, 9 Drawing Sheets

PHASE DETECTION APPARATUS AND METHOD AND AUDIO CODING APPARATUS AND METHOD

CROSS REFERENCES TO RELATED APPLICATIONS

This application is related to concurrently-filed commonly assigned U.S. patent application Ser. No. 09/236,500, now U.S. Pat. No. 6,115,685, issued Sep. 5, 2000.

BACKGROUND OF THE INVENTION

1. Field of the Invention

The present invention relates to a phase detection apparatus and method, and an audio coding apparatus and method, for detecting phases of harmonics components in a sinusoidal wave combine coding or the like.

2. Description of the Prior Art

Various coding methods are known to carry out signal compression utilizing statistical features and human hearing sense characteristics in a time region and frequency region of an audio signal (including a voice signal and an acoustic signal). These coding methods can be briefly classified into time region coding, frequency region coding, and analysis-synthesis coding.

As a high-efficiency coding of an audio signal or the like, there are known sinusoidal coding schemes such as harmonic coding and multi-band excitation (MBE) coding, and sub-band coding (SBC), linear predictive coding (LPC), or discrete cosine transform (DCT), modified DCT (MDCT), fast Fourier transform (FFT), and the like.

In the high-efficiency audio coding using the sinusoidal coding such as the MBE coding, harmonic coding, and sinusoidal transform coding (STC) for an input audio signal or using these sinusoidal coding methods for an input audio signal LPC, information is transmitted on an amplitude or spectrum envelope of each sinusoidal wave (harmonics, higher harmonics) serving as a component of analysis-synthesis. However, no information on phase is transmitted. The phase is calculated during synthesis if necessary.

Accordingly, there is a problem that an audio waveform reproduced after decoding is different from a waveform of the original input audio signal. That is, in order to reproduce the original waveform, it is necessary to detect and transmit phase information of each harmonics (higher harmonics) component for each frame.

SUMMARY OF THE INVENTION

It is therefore an object of the present invention to provide a phase detection apparatus and method for realizing reproduction of an original waveform as well as an audio coding apparatus and method employing this phase detection technique.

In the phase detection apparatus and method according to the present invention, one-pitch cycle of an input signal waveform based on an audio signal is cut out on a time axis. The cut-out one-pitch cycle of samples is subjected to an orthogonal conversion such as FFT. According to a real part and an imaginary part of data which has been orthogonally converted, phase information is detected for each higher harmonics component of the aforementioned input signal.

According to another aspect of the present invention, the aforementioned phase detection is applied to an audio coding such as sinusoidal coding.

Here, the aforementioned input signal waveform may be an audio signal waveform itself or a signal waveform of a short-term prediction residue of the audio signal.

Moreover, it is preferable that the aforementioned cut-out waveform data is filled with zeroes into $2^N$ samples (where N is an integer, $2^N$ is equal to or greater than the number of samples of the aforementioned one-pitch cycle) when subjected to an orthogonal conversion, which is preferably the fast Fourier transform.

Furthermore, the aforementioned phase detection may be performed by using a real part and an imaginary part of the data obtained by the orthogonal conversion, so as to calculate an inverse tangent ($\tan^{-1}$) to obtain a phase of each higher harmonics component.

DETAILED DESCRIPTION OF PREFERRED EMBODIMENTS

The phase detection apparatus and method according to the present invention is to be applied, for example, to multi-band excitation (MBE) coding, sinusoidal transform coding (STC), harmonic coding, and other sinusoidal wave synthesis coding as well as to the aforementioned sinusoidal wave synthesis coding used for linear predictive coding (LPC).

Here, before starting description of the embodiment of the present invention, an explanation will be given on an audio coding apparatus that carries out a sinusoidal wave analysis-synthesis (combine) coding as an apparatus to use the phase detection apparatus or method according to the present invention.

Figure 1:
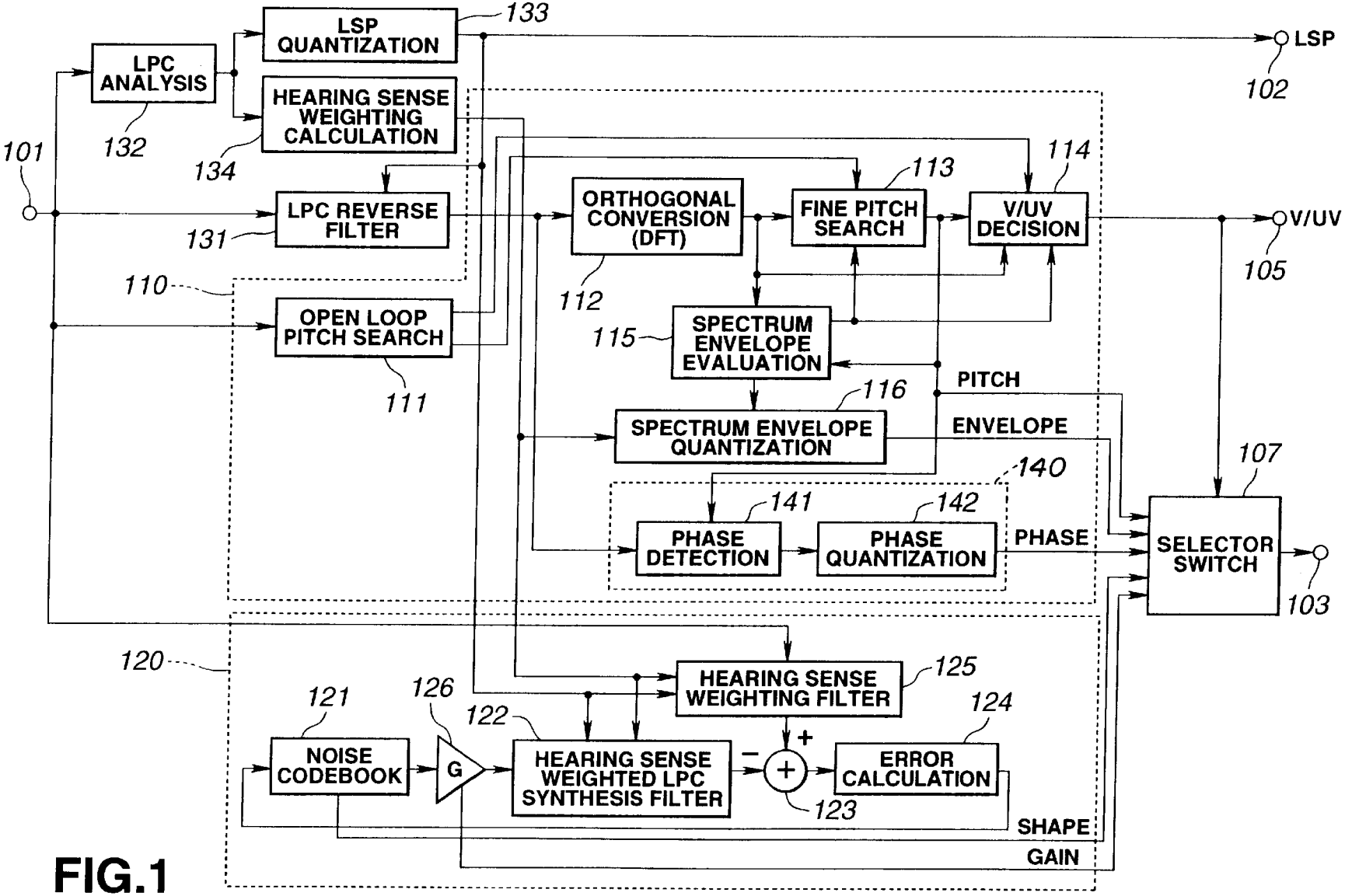
FIG. 1 is a block diagram schematically showing a configuration example of an audio coding apparatus to employ a phase detection apparatus and method according to an embodiment of the present invention.

FIG. 1 schematically shows a specific configuration example of the audio coding apparatus to which the aforementioned phase detection apparatus or method is to be applied.

The audio signal coding apparatus of FIG. 1 includes: a first encoder 110 for carrying out a sinusoidal analysis coding such as harmonic coding to an input signal; and a second encoder 120 for carrying out to the input signal a code excitation linear predictive (CELP) coding using a vector quantization by way of closed loop search of an optimal vector using an analysis by synthesis (combine) for example, so that the first encoder 110 is used for a voiced part of the input signal and the second encoder 120 is used for an unvoiced part of the input signal. The phase detection according to the embodiment of the present invention is applied to the first encoder 110. It should be noted that in the example of FIG. 1, a short-term prediction residual such as a linear predictive coding (LPC) residual of an input audio signal is obtained before the input audio signal is fed to the first encoder 110.

In FIG. 1, the audio signal fed to an input terminal 101 is transmitted to an LPC reverse filter 131 and an LPC analyzer 132 as well as to an open loop pitch searcher 111 of the first encoder 110. The LPC analyzer 132 applies a hamming window over a block of an analysis length equal to about 256 samples of the input signal waveform and uses the self-correlation method to obtain a linear prediction coefficient, i.e., a so-called alpha parameter. The data output unit, i.e., the framing interval is set to about 160 samples. Here, if the input audio signal has a sampling frequency fs of 8 kHz, one frame interval is 160 samples, 20 msec.

The alpha parameter from the LPC analyzer 132 is converted into a linear spectrum pair (LSP) parameter by way of alpha to LSP conversion. For example, the alpha parameter obtained as a direct type filter coefficient is converted into ten, i.e., five pairs of LSP parameter. The conversion is carried out by way of Newton-Raphson method for example. This conversion into LSP parameter is carried out because the LSP parameter has a superior interpolation characteristic than the alpha parameter. This LSP parameter is matrix-quantized or vector-quantized by an LSP quantizer 133. Here, it is possible to obtain a difference between frames before carrying out the vector quantization, or it is possible to carry out the matrix quantization for a plurality of frames at once. Here, 20 msec is assumed to be one frame, and the LSP parameters are calculated for each 20 msec. LSP parameters of two frames are together subjected to the matrix quantization and the vector quantization.

This LSP quantizer 133 outputs a quantized output, i.e., an index of the LSP quantization is taken out via a terminal 102, whereas the LSP vector which has been quantized is subjected, for example, to an LSP interpolation and LSP to alpha conversion into an alpha parameter of the LPC, which is directed to the LPC reverse filter 131 as well as to a hearing sense-weighted LPC combine filter 122 and a hearing sense-weighting filter 125 of the second encoder 120 which will be detailed later.

Moreover, the alpha parameter from the LPC analyzer 132 is transmitted to a hearing sense-weighting filter calculator 134 to obtain a data for hearing sense weighting. This weighting data is transmitted to a hearing sense weighted vector quantizer 116 which will be detailed later as well as to a hearing sense weighted LPC synthesis (combine) filter 122 and hearing sense weighting filter 125 of the second encoder 120.

In the LPC reverse filter 131, a reverse filtering processing is performed using the aforementioned alpha parameter to take out a linear prediction residual (LPC residual) of the input audio signal. An output from this LPC reverse filter 131 is transmitted to the first encoder 110 so as to be subjected to sinusoidal coding such as harmonic coding by the orthogonal converter 112 such as a discrete Fourier transform (DFT) circuit as well as to the phase detector 140.

Moreover, the open loop pitch searcher 111 of the encoder 110 is supplied with the input audio signal from the input terminal 101. The open loop pitch searcher 111 determines an LPC residual of the input signal and performs a rough pitch search by way of the open loop. A rough pitch data extracted is fed to a high-accuracy (fine) pitch searcher 113 to be subjected to a high-accuracy pitch search (fine search of a pitch) by way of a closed loop which will be detailed later.

Moreover, the open loop pitch searcher 111 outputs together with the aforementioned rough pitch data, a normalized-by-power self-correlation maximum value r (p) which is the maximum value of self correlation of the LPC residual and transmitted to a V/UV (voiced/unvoiced) decider 114.

In the orthogonal converter 112, for example, an orthogonal conversion such as discrete Fourier transform (DFT) is performed so that an LPC residue on time axis is converted into a spectrum amplitude data on a frequency axis. An output from this orthogonal converter 112 is transmitted to the fine pitch searcher 113 and to a spectrum envelope evaluator 115 for evaluation of a spectrum amplitude or envelope.

The fine pitch searcher 113 is supplied with the rough pitch data extracted in the open loop pitch searcher 111 and the data on the frequency axis after the DFT for example, in the orthogonal converter 112. In the fine pitch searcher 113, around the aforementioned rough pitch data value, at an interval of plus and minus 0.2 to 0.5 several samples are selected to obtain a fine pitch data with an optimal floating point. As the fine search technique, a so-called analysis-by-synthesis method is used to select a pitch so that a power spectrum synthesized is at nearest to the original audio power spectrum. Information on the pitch data from the fine pitch searcher 146 using such a closed loop is transmitted to the spectrum envelope evaluator 115, the phase detector 141, and a selector switch 107.

In the spectrum envelope evaluator 115, according to the spectrum amplitude and pitch as an output of orthogonal conversion of the LPC residue, size of respective harmonics and their spectrum envelopes are evaluated. The evaluation result is transmitted to the fine pitch searcher 113, V/UV (voiced/unvoiced) decider 114 and to a spectrum envelope quantizer 116. The spectrum envelope quantizer 116 is a hearing sense weighted vector quantizer.

In the V/UV (voiced/unvoiced) decider 114, a frame is decided to be voiced or unvoiced according to the output from the orthogonal converter 112, the optimal pitch from the fine pitch searcher 113, the spectrum amplitude data from the spectrum envelope evaluator 115, and the normalized self-correction maximum value r (p) from the open loop pitch searcher 111. Furthermore, a boundary position of V/UV decision for each band in case of MBE may also be used as a condition to make the V/UV decision. The decision made by this V/UV decider 115 is taken out via an output terminal 105.

On the other hand, a data count converter (a kind of sampling rate converter) is provided at the output of the spectrum evaluator 115 or the input of the spectrum envelope quantizer 116. This data count converter is used to keep a constant number of the envelope amplitude data items $|A_m|$, considering that the number of divided bands on the frequency axis varies depending on the aforementioned pitch. That is, suppose the valid band is up to 3400 kHz. This valid band is divided to 8 to 63 bands according to the aforementioned pitch. Accordingly, the number of amplitude data items $|A_m|$ also changes from 8 to 63. To cope with this, the aforementioned data count converter converts this variable number of amplitude data items into a constant number such as 44 items.

The data count converter provided at the output of the spectrum envelope evaluator 115 or the input of the envelope quantizer 116 outputs the aforementioned constant number (for example, 44) of amplitude data or envelope data which are gathered by the spectrum envelope quantizer 116 into a predetermined number, for example, 44 data items that are subjected as a vector to the weighted vector quantization. This weight is given by an output from the hearing sense weighting filter calculation circuit 134. The index of the envelope from the spectrum envelope quantizer 116 is fed to the selector switch 107.

The phase detector 141 detects a phase information including a phase and a fixed delay component of the phase for each harmonics (higher harmonics) of the sinusoidal coding as will be detailed later. This phase information is transmitted to a phase quantizer 142 for quantization and the phase data quantized is transmitted to the selector switch 107.

The selector switch 107 is responsive to the V/UV decision output from the V/UV decider 115 to switch for output from the terminal 103 between the pitch, the vector quantized index of the spectrum envelope, and phase data from the first encoder 110, and a shape and gain data from the second encoder 120 which will be detailed later.

The second encoder 120 of FIG. 1 has a configuration of code excitation linear prediction (CELP) coding in this example. An output from a noise codebook 121 is subjected to combine processing by the combine filter 122. The weighted audio thus obtained is fed to a subtractor 123, so as to take out a difference between the audio signal supplied to the input terminal 101 and the audio obtained via the hearing sense weighting filter 125. This difference is supplied to a distance calculation circuit 124 to perform a distance calculation, and the noise codebook 121 is searched for a vector which minimizes the difference. That is, a vector quantization of waveform on time axis is performed using a closed loop search by way of the analysis-by-synthesis method. This CELP coding is used for coding of the unvoiced part as has been described above. The codebook index as an UV data from the noise codebook 121 is taken out from the output terminal 103 via the selector switch 103 when the V/UV decision result from the V/UV decider 115 is unvoiced (UV).

Next, explanation will be given on a preferred embodiment of the present invention.

The phase detection apparatus and method according to an embodiment of the present invention is used in the phase detector 141 of the audio signal coding apparatus shown in FIG. 1 but not to be limited to this application.

Figure 2:
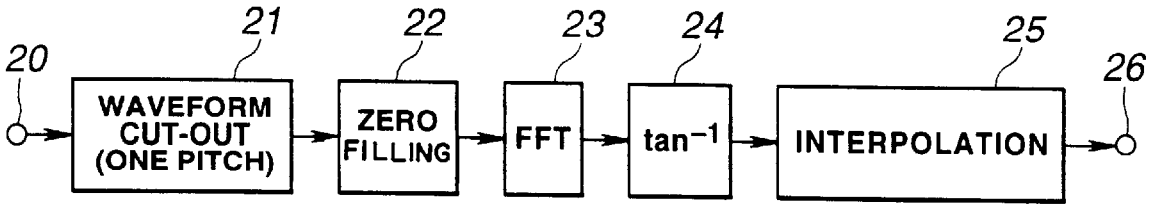
FIG. 2 is a block diagram schematically showing the phase detection apparatus according to the embodiment of the present invention.
Figure 3:
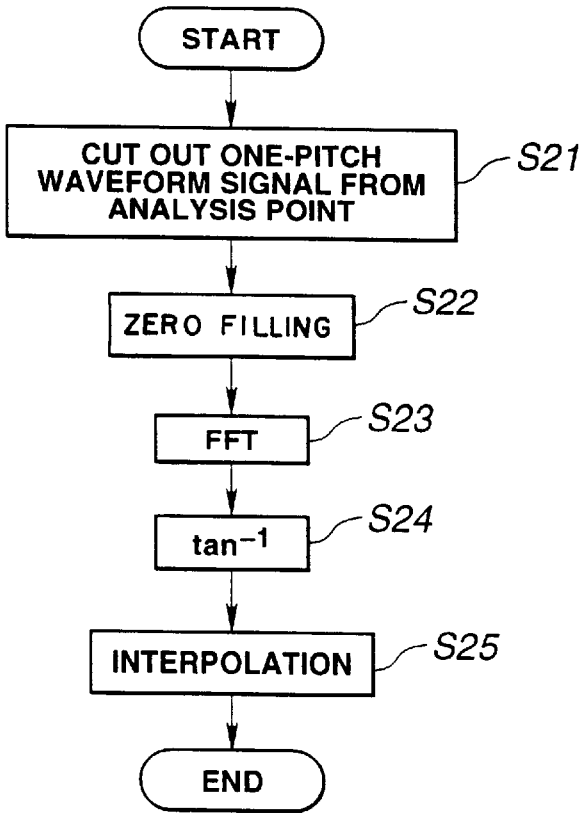
FIG. 3 is a flowchart explaining the phase detection method according to the embodiment of the present invention.

Firstly, FIG. 2 is a block diagram schematically showing the phase detection apparatus according to a preferred embodiment of the present invention. FIG. 3 is a flowchart for explanation of the phase detection method according to a preferred embodiment of the present invention.

Figure 4:
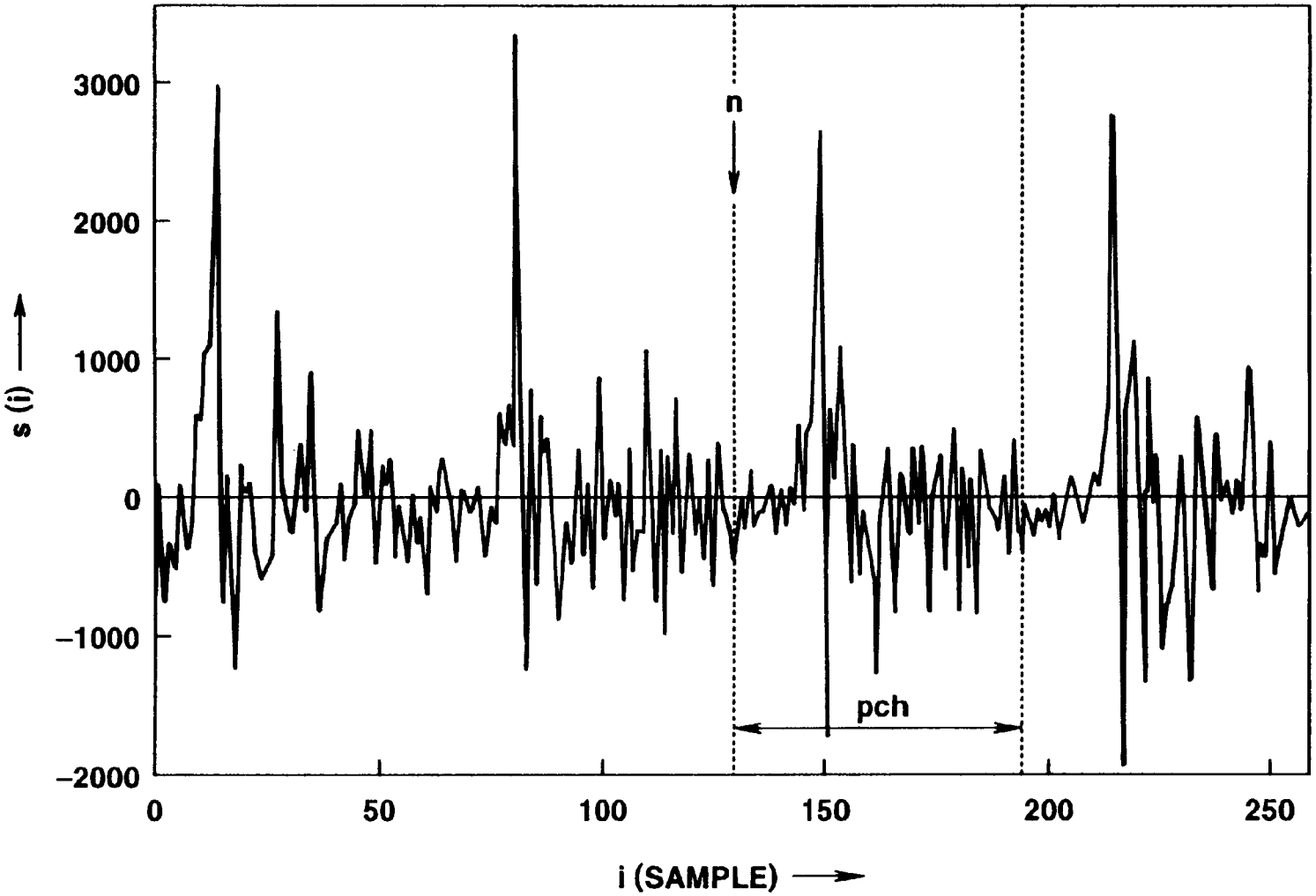
FIG. 4 is a waveform chart showing an example of an input signal to be subjected to the phase detection.

An input signal supplied to an input terminal 20 of FIG.2 may be a digitized audio signal itself or a short-term prediction residual signal (LPC residual signal) of a digitized audio signal such as a signal from the LPC reverse filter 131 of FIG. 1 From this input signal, a waveform signal of one-pitch cycle is cut out by a waveform cutter 21 as step S21 in FIG. 3. As shown in FIG. 4, a number of samples (pitch lag) pch corresponding to one pitch cycle are cut off starting at an analysis point (time) n in an analysis block of the input signal s (i) (audio signal or LPC residual signal). In the example of FIG. 4, the analysis block length is 256 samples, but not to be limited to this. Moreover, the horizontal axis of FIG. 4 represents a position in the analysis block or time as the number of samples. The aforementioned analysis point n as a position or time represents the n-th sample from the analysis start.

Figure 5:
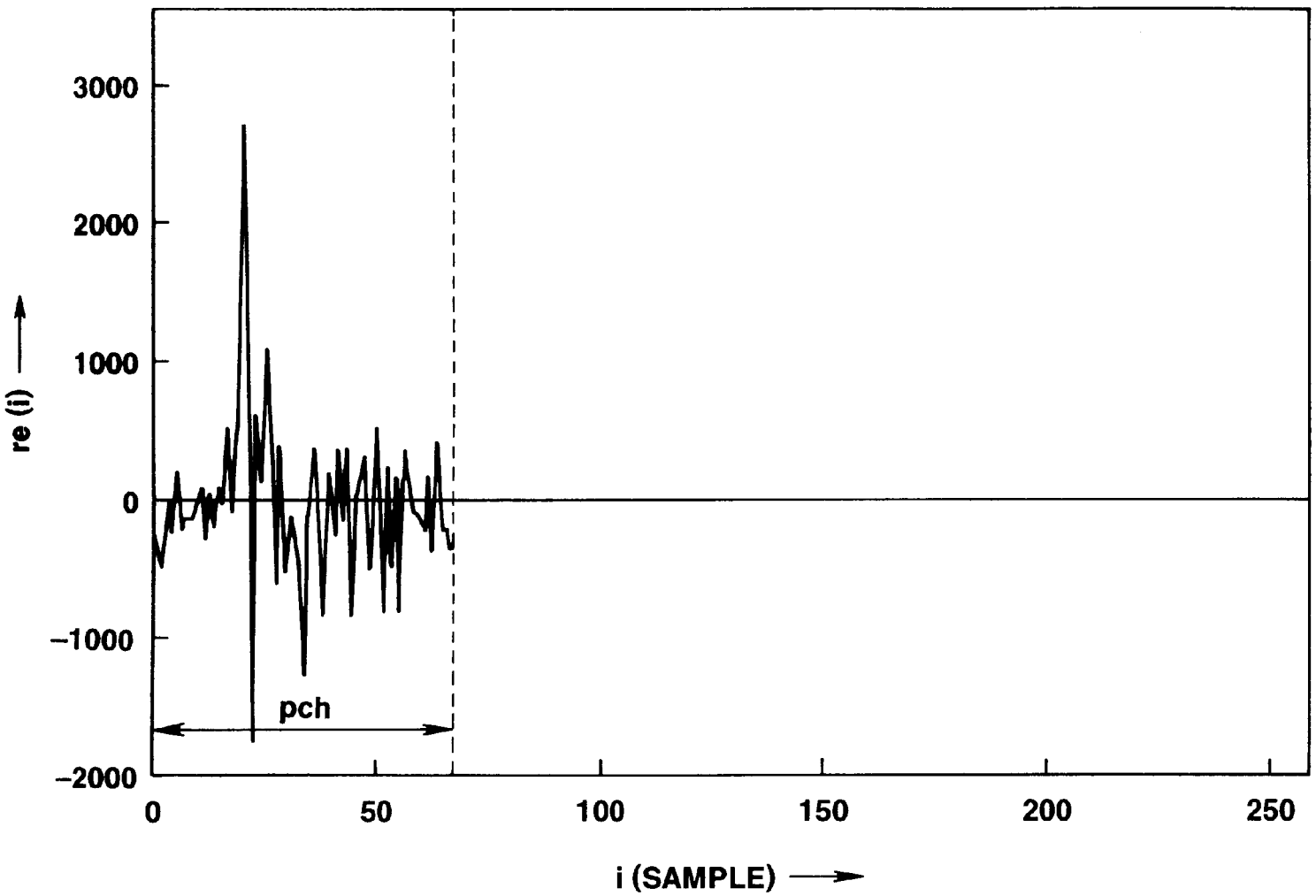
FIG. 5 shows a waveform example of one-pitch waveform data filled with zeroes.

This one-pitch waveform signal which has been cut out is subjected to a zero filling processing by a zero filler 22 in step S22 of FIG. 3. In this processing, as shown in FIG. 5, the signal waveform of the aforementioned one-pitch lag pch sample is arranged at the head, the signal length is set to $2^N$ samples, i.e., $2^8$=256 samples in this embodiment, and the rest is filled with zeroes, so as to obtain a signal string re(i) (wherein, $0 \leqq i < 2^N$).

$$re(i) = \begin{cases} s(n+i) & (0 \le i < pch) \\ 0 & (pch \le i < 2^N) \end{cases} \tag{1}$$

Next, this signal string re(i) filled with zeroes is used as a real number part with an imaginary number signal string im(i)

$$im(i)=0(0 \leqq i < 2^N)$$

by the FFT processor 23 in step S23 of FIG. 3. That is the real number signal string re(i) and the imaginary number signal string im(i) are subjected to a $2^N$-point FFT (fast Fourier transform).

The result of this FFT is processed by a $\tan^{-1}$ processor 24 in step S24 of FIG. 3 to calculate $\tan^{-1}$ (reverse tangent) so as to obtain a phase. If it is assumed that the FFT execution result has a real number part Re(i) and an imaginary number part Im(i), the component of $0 \leqq i < 2^{N-1}$ corresponds to a component of 0 to π (rad) on the frequency axis. Consequently, the phase φ(ω) of the range ω=0 to π on this frequency axis can be obtained for $2^{N-1}$ points from Formula (2) as follows. A specific example of the phase obtained (solid line) is shown by a solid line in FIG. 6.

$$\phi\left(\frac{i}{2^{N-1}}\pi\right) = \tan^{-1}\left(\frac{I_m(i)}{R_e(i)}\right)(0 \le i < 2^{N-1}) \tag{2}$$

Because the pitch flag of the analysis block around the aforementioned time n (sample) is pch (sample), the basic frequency (angular frequency) $\omega_0$ at time n can be expressed as follows.

$$\omega_0 = 2\pi/pch \tag{3}$$

M harmonics (higher harmonics) are present at an interval of $\omega_0$ on the frequency axis in the range of ω=0 to π. This M is:

$$M = pch/2 \tag{4}$$

The phase φ(ω) obtained by the aforementioned tan−1 processor 24 is a phase at point $2^{N-1}$ on the frequency axis determined by the analysis block length and the sampling frequency, regardless of the pitch flag pch and the basic frequency $\omega_0$. Accordingly, in order to obtain a phase of each of the harmonics at the interval $\omega_0$ of the basic frequency, the interpolation processor 25 performs an interpolation in step S25 of FIG. 3. This processing is a linear interpolation of the phase of the m-th harmonics $\phi_m = \phi$ (m$\times\omega_0$) (wherein $1 \leqq m \leqq M$). The phase data of interpolated harmonics is taken out from an output terminal 26.

Here, an explanation will be given on a case of linear interpolation with reference to FIG. 7 and FIG. 8. The values id, idL, idH, phaseL, phaseH in FIG. 7 and FIG. 8 respectively represent the following.

$$id = m \times \omega_0 \tag{5}$$

$$idL = \lfloor id \rfloor = \text{floor}(id) \tag{6}$$

$$idH = \lceil id \rceil = ccil(id) \tag{7}$$

$$\text{phase}L = \phi\left(\frac{idL}{2^{N-1}}\pi\right) \tag{8}$$

$$\text{phase}H = \phi\left(\frac{idH}{2^{N-1}}\pi\right) \tag{9}$$

wherein $\lfloor x \rfloor$ is a maximum integer not exceeding x and can also be expressed as floor(x); $\lceil x \rceil$ is a minimum integer greater than x and can also be expressed as ceil(x).

That is, positions on the frequency axis corresponding to the $2^{N-1}$ point phase obtained above are expressed by integer values (sample numbers). If the m-th harmonics frequency id ($=m\times\omega_0$) is present between two adjacent positions idL and idH in these $2^{N-1}$ points, the phaseL of position idl and the phaseH of the position idH are used for linear interpolation so as to calculate the phase $\phi_m$ at the m-th harmonics frequency id. This linear interpolation is calculated as follows.

$$\phi_m = \begin{cases} (idH - id) \times (\text{phase}L + 2\pi) + (id - idL) \times \text{phase}H \\ \left(\text{phase}L < -\frac{1}{2}\pi \text{ and } \text{phase}H > \frac{1}{2}\pi\right) \\ (idH - id) \times \text{phase}L + (id - idL) \times \text{phase}H \\ (\text{otherwise}) \end{cases} \tag{10}$$

Figure 7:
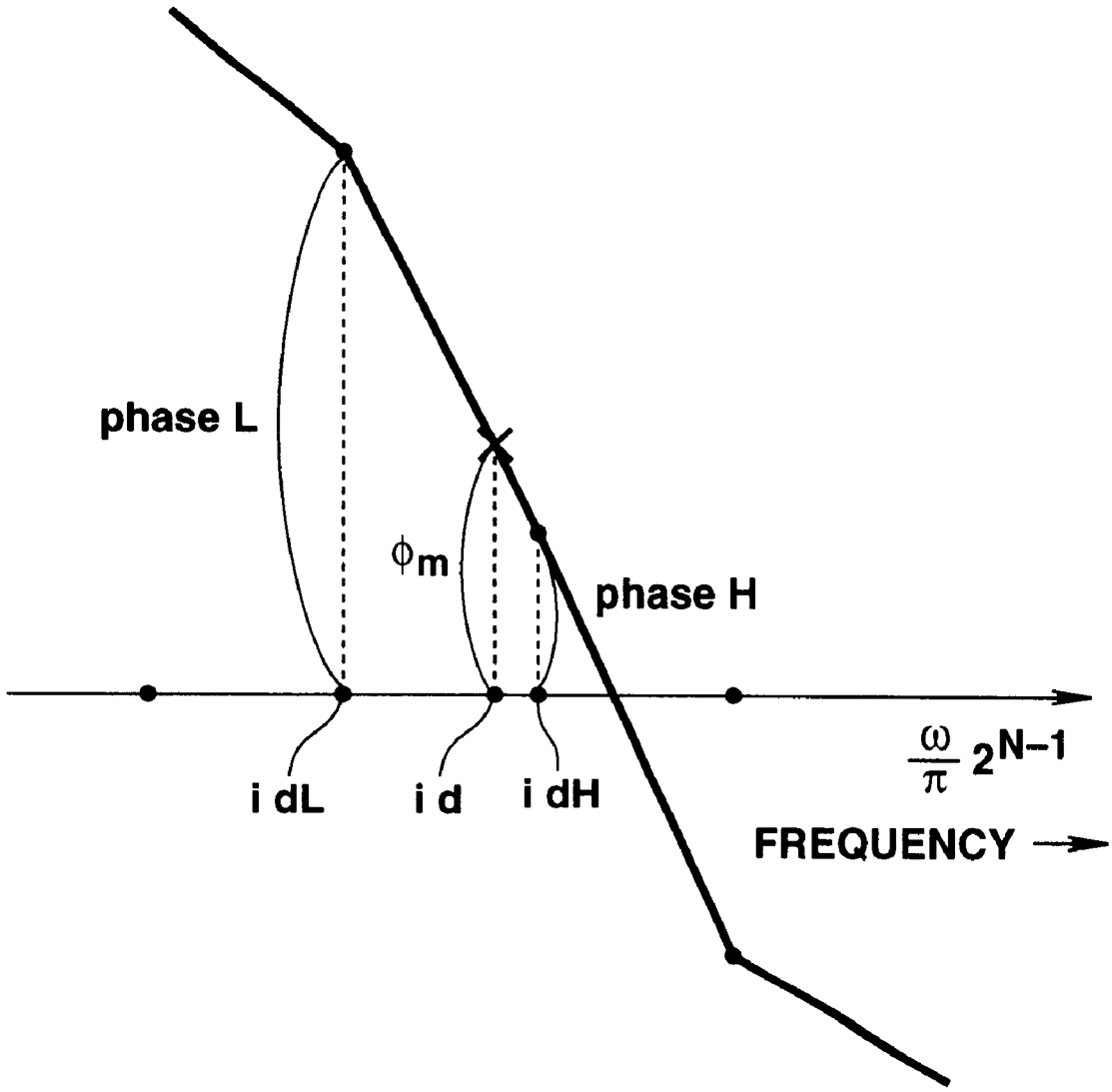
FIG. 7 shows an example of interpolation for a continuous phase.

FIG. 7 shows a case in which two adjacent positions idL and idH in the $2^{N-1}$ points are used for interpolation between their phases phaseL and phaseH, so as to calculate the phase $\phi_m$ at the m-th harmonics position id.

Figure 8:
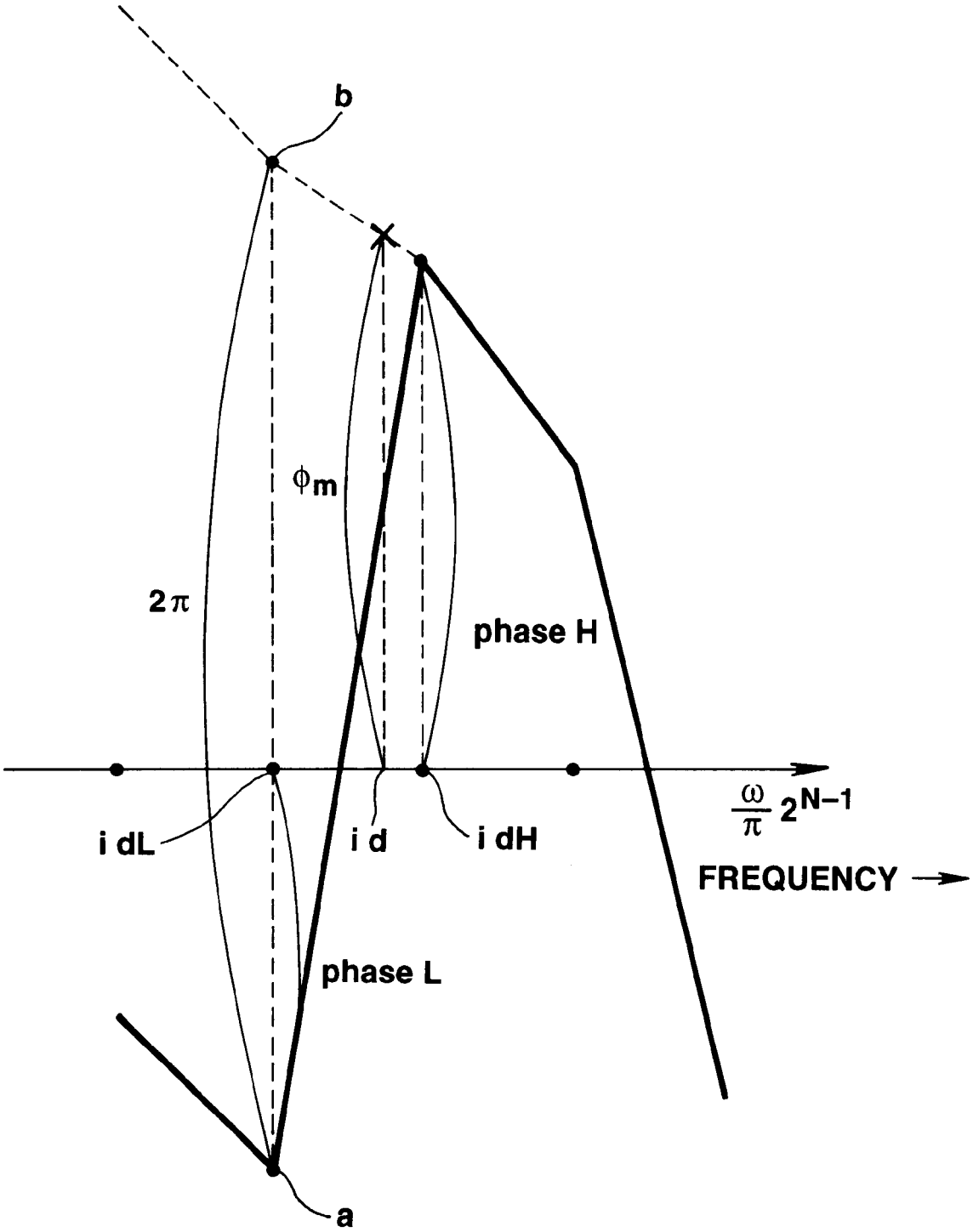
FIG. 8 shows an example of interpolation for a discontinuous phase.

In contrast to this, FIG. 8 shows an example of interpolation, taking consideration on a phase discontinuity. That is, as the phase $\phi_m$ obtained by the $\tan^{-1}$ calculation is continuous in $2\pi$ cycle, the phaseL (point a) of the position idL on the frequency axis is added by $2\pi$ to determine a value (point b) for linear interpolation with the phaseH at position idH, so as to calculate the phase $\phi_m$ at the m-th harmonics position id. Such a calculation to keep phase continuity by adding $2\pi$ is called a phase unwrap processing.

Figure 6:
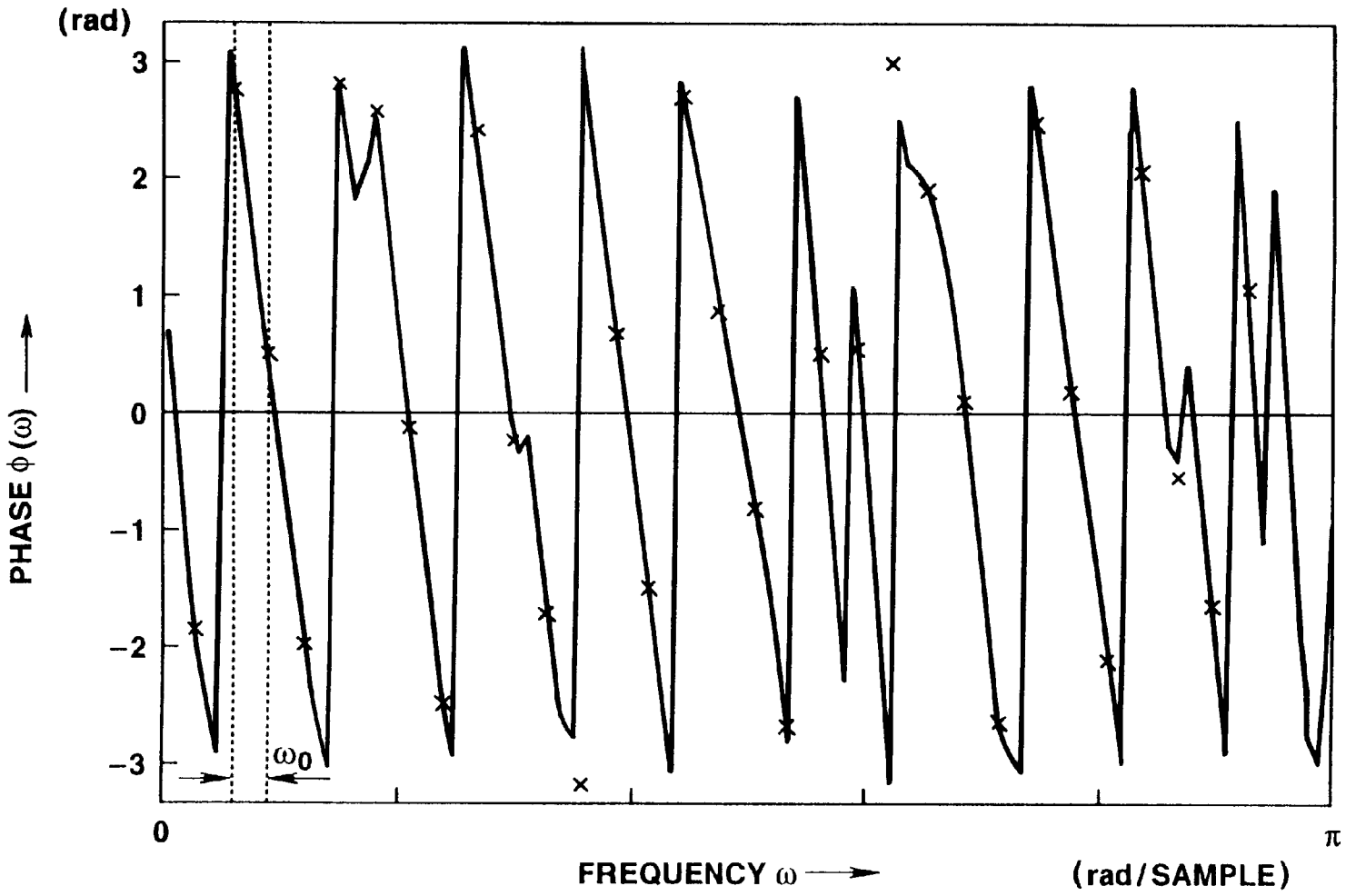
FIG. 6 shows an example of phase detected.

The mark of cross (X) in FIG. 6 indicates a phase of the harmonics thus obtained.

Figure 9:
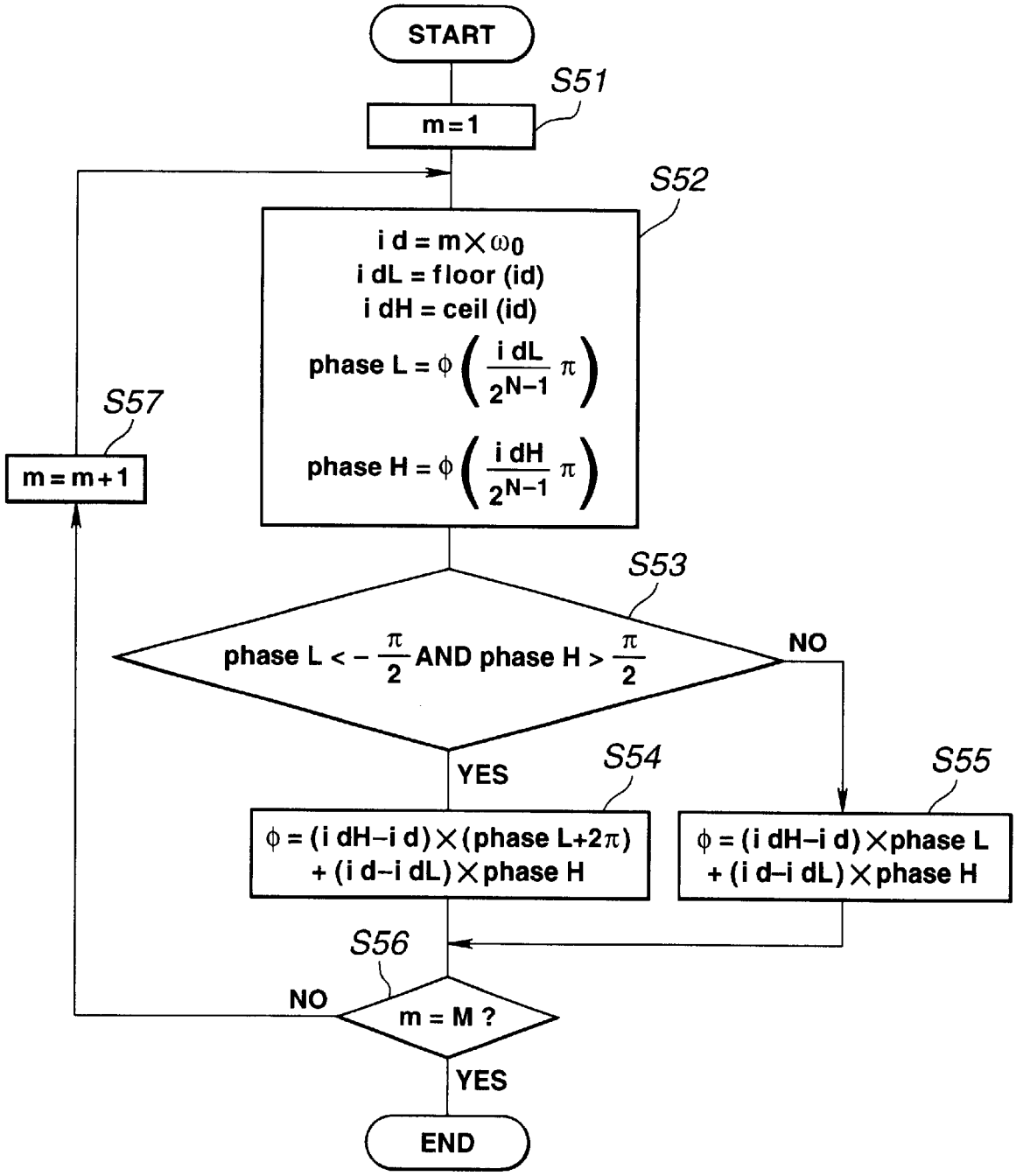
FIG. 9 is a flowchart explaining an example of linear interpolation procedure of phase detection.

FIG. 9 is a flowchart showing a calculation procedure to obtain the aforementioned harmonics phase $\phi_m$ using a linear interpolation. In the flowchart of FIG. 9, in the first step S51, the harmonics number m is initialized (m=1), and control is passed to the next step S52, where the aforementioned values id, idL idH, phaseL, and phaseH are calculated for the m-th harmonics, so that in the next step S53, a decision is made whether the phase is continuous. If the phase is decided to be discontinuous in this step S53, control is passed to step S54, and otherwise, control is passed to step S55. That is, in case of a discontinuous phase, control is passed to step S54, where the phaseL at position idL on the frequency axis is added by $2\pi$ for a linear interpolation with the phaseH at position idH, so as to obtain the m-th harmonics phase $\phi_m$. In case of a continuous phase, control is passed to step S55, where a linear interpolation is performed between the phaseL and the phaseH, to obtain the m–h harmonics phase $\phi_m$. In the next step S56, it is decided whether the harmonics number m has reached the aforementioned M. If NO, the m is incremented ( m=m+1) and control is returned to step S52. If YES, the processing is terminated.

Figure 10:
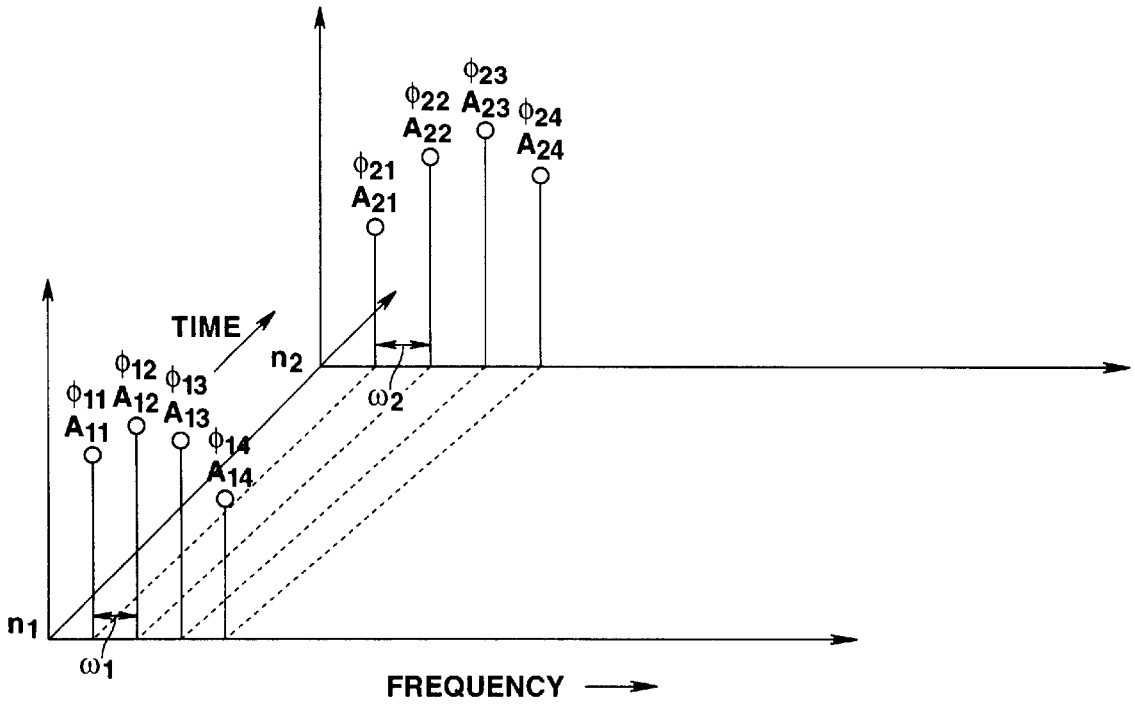
FIG. 10 explains an example of sinusoidal wave synthesis when a phase information has been obtained.

Next, an explanation will be given on a specific example of sinusoidal wave synthesis using the phase information thus obtained, with reference to FIG. 10. Here, a time waveform of a frame interval $L=n_2-n_1$ from time $n_1$ to $n_2$ is reproduced by sinusoidal synthesis.

If the pitch lag at time $n_1$ is $pch_1$ (sample), and the pitch lag at time $n_2$ is $pch_2$ (sample), the pitch frequency $\omega_1$ and $\omega_2$ (rad/sample) at time $n_1$, $n_2$ are respectively as follows.

$$\omega_1 = 2\pi/pch_1 \tag{11}$$

$$\omega_2 = 2\pi/pch_2 \tag{12}$$

Moreover, it is assumed that the amplitude data of each harmonics component is $A_{11}$, $A_{12}$, $A_{13}$, . . . at time $n_1$, and $A_{21}$, $A_{22}$, $A_{23}$ at time $n_2$; the phase data of each harmonics component is $\phi_{11}$, $\phi_{12}$, $\phi_{13}$, . . . at time $n_1$, and $\phi_{21}$, $\phi_{22}$, $\phi_{23}$, . . . at time $n_2$.

When the pitch is continuous, the amplitude of the m-th harmonics component at time n ($n_1 \leqq n \leqq n_2$) is obtained by linear interpolation of the amplitude data at time $n_1$ and $n_2$ as follows.

$$A_m(n) = \frac{n_2 - n}{L} A_{1m} + \frac{n - n_1}{L} A_{2m} (n_1 \le n \le n_2) \tag{13}$$

Here, it is assumed that the frequency change of the m-th harmonics component between time $n_1$ and $n_2$ is (linear change)+(fixed change) as follows.

$$\tilde{\omega}_m(n) = n\tilde{\omega}_1 n_2 - \frac{n}{L} + m\tilde{\omega}_2 n - \frac{n_1}{L} + \Delta\tilde{\omega}_m (n_1 \le n < n_2) \tag{14}$$

Here, phase $\theta_m(n)$(rad) of the m-th harmonics component at time n can be expressed as Expression (15), from which Expression (17) can be obtained.

$$\theta_m(n) = \int_{n1}^{n} \tilde{\omega}_m(\xi)\, d\xi + \phi_{1m} \tag{15}$$

$$= \int_{n1}^{n} \left(m\tilde{\omega}_1 n_2 - \frac{\xi}{L} + m\tilde{\omega}_2 \xi - \frac{n_1}{L} + \Delta\tilde{\omega}_m\right) d\xi + \phi_{1m} \tag{16}$$

$$= m\tilde{\omega}_1 (n - n_1) + m(\tilde{\omega}_2 - \tilde{\omega}_1)\frac{(n - n_1)^2}{2L} + \Delta\tilde{\omega}_m L + \phi_{1m} \tag{17}$$

Consequently, the phase $\phi_{2m}$(rad) of the m-th harmonics component at time $n_2$ can be expressed by Expression (19) given below.

$$\phi_{2m} = \theta_m(n_2) \tag{18}$$

$$= \frac{m(\tilde{\omega}_1 + \tilde{\omega}_2)L}{2} + \Delta\tilde{\omega}_m L + \phi_{1m} \tag{19}$$

Therefore, the frequency change $\Delta\omega_m$ (rad/sample) of each harmonics component can be expressed by Expression (20).

$$\Delta\tilde{\omega}_m = \frac{(\phi_{1m} - \phi_{2m})}{L} - \frac{m(\tilde{\omega}_1 + \tilde{\omega}_2)}{2} \tag{20}$$

Thus, the phase $\phi_{1m}$, $\phi_{2m}$ at time $n_1$, $n_2$ are given for the m-th harmonics component. Accordingly, the fixed change $\Delta\omega_m$ of the frequency change is obtained from the Expression (20), and the phase $\theta_m$ at time n is obtained from the Expression (17), then the time waveform $W_m(n)$ by the m-th harmonics component can be expressed as follows.

$$W_m(n)=A_m(n)\cos(\theta_m(n))\ (n1 \leqq n \leqq n2) \tag{21}$$

The time waveforms obtained for all the harmonics components are summed up into a synthesized waveform V(n) as shown in Expressions (22) and (23).

$$V(n) = \sum_m W_m(n) \tag{22}$$

$$= \sum_m A_m(n)\cos(\theta_m(n))(n_1 \le n \le n_2) \tag{23}$$

Next, explanation will be given on a case of discontinuous pitch. When the pitch is discontinuous, no consideration is taken on the continuity of the frequency change. A window is applied over the waveform $V_1(n)$ shown in Expression (24) as a result of sinusoidal synthesis in the forward direction from time $n_1$ and the waveform $V_2(n)$ shown in Expression (25) as a result of sinusoidal synthesis in the backward direction from time $n_2$, which are subjected to overlap add.

$$V_1(n) = \sum_m A_{1m}\cos(m\tilde{\omega}_1(n-n_1)+\phi_{1m}) \tag{24}$$

$$V_2(n) = \sum_m A_{2m}\cos(-m\tilde{\omega}_2(n_2-n)+\phi_{2m}) \tag{25}$$

In the phase detection apparatus as has been described, using a pitch frequency pre-detected, it is possible to rapidly detect a phase of a desired harmonic component by way of FFT and linear interpolation. This enables to realize a wave form reproductivity in a sinusoidal synthesis coding for an LPC residual of an audio signal.

It should be noted that the present intention is not to be limited to the aforementioned embodiment. For example, the configuration of FIG. 1 described as hardware can also be realized by a software program using a so-called DSP (digital signal processor).

As is clear from the aforementioned, according to the phase detection apparatus and method according to the present intention, one-pitch cycle of an input signal waveform based on an audio signal is cut out so that samples of the one-pitch cycle are subjected to an orthogonal conversion such as FFT, and a real part and an imaginary part of the orthogonally transformed data are used to detect a phase information of respective higher harmonics component of the aforementioned input signal, enabling to detect a phase information of an original waveform, thus improving the waveform reproductivity.

By using a pitch detected in advance for the FFT (fast Fourier transform) and linear interpolation, it is possible to rapidly detect a phase of each of the harmonics (higher harmonics) components. When this is applied to an audio coding such as a sinusoidal synthesis coding, it is possible to improve the waveform reproductivity. For example, it is possible to prevent generation of an unnatural sound when synthesized.

What is claimed is:

1. A phase detection apparatus comprising:

waveform cut-out means for cutting out on a time axis a one-pitch cycle of an input signal waveform and producing cut-out waveform data, wherein said one-pitch cycle is comprised of a number of samples;

orthogonal conversion means for performing an orthogonal conversion of said cut-out waveform data and producing orthogonally converted data therefrom; and phase detection means for detecting a phase information of respective higher harmonics components of said input signal waveform according to a real part and an imaginary part of said orthogonally converted data from said orthogonal conversion means.

2. The phase detection apparatus as claimed in claim 1, wherein said input signal waveform is an audio signal waveform.

3. The phase detection apparatus as claimed in claim 1, wherein said input signal waveform is a signal waveform of a short-term prediction residual of an audio signal.

4. The phase detection apparatus as claimed in claim 1, wherein said cut-out waveform data from said waveform cut-out means is filled with zeros to form $2^N$ samples fed to said orthogonal conversion means, wherein N is an integer, and $2^N$ is equal to or greater than said number of samples of said one-pitch cycle.

5. The phase detection apparatus as claimed in claim 1, wherein said orthogonal conversion means is a fast Fourier transform circuit.

6. The phase detection apparatus as claimed in claim 1, wherein said phase detection means uses said real part and said imaginary part of said orthogonally converted data from said orthogonal conversion means to calculate an inverse tangent ($\tan_{-1}$) to obtain a basic phase information and performs interpolation to said basic phase information to obtain said phase information of said respective higher harmonics.

7. A phase detection method comprising the steps of:

cutting out on a time axis a one-pitch cycle of an input signal waveform based on an audio signal and producing cut-out waveform data, wherein said one-pitch cycle is comprised of a number of samples;

performing an orthogonal conversion of said cut-out waveform data and producing orthogonally converted data therefrom; and detecting a phase information of respective higher harmonics components of said input signal waveform according to a real part and an imaginary part of said orthogonally converted data from said orthogonal conversion means.

8. The phase detection method as claimed in claim 7, wherein said cut-out waveform data obtained in said waveform cut-out step is filled with zeroes to form $2^N$ samples fed to said orthogonal conversion means, wherein N is an integer, and $2^N$ is equal to or greater than said number of samples of said one-pitch cycle.

9. The phase detection method as claimed in claim 7, wherein said real part and said imaginary part of said orthogonally converted data obtained in said orthogonal conversion step are used to calculate an inverse tangent ($\tan^{-1}$) to obtain a basic phase information, which is subjected to interpolation to obtain said phase information of said respective higher harmonics.

10. An audio coding apparatus for dividing an input signal waveform based on an audio signal into blocks on a time axis, obtaining a pitch for each of said blocks, and performing sinusoidal wave analysis-by-synthesis encoding on each of said blocks, said apparatus comprising:

waveform cut-out means for cutting out on a time axis a one-pitch cycle of said input signal waveform and producing cut-out waveform data wherein said one-pitch cycle is comprised of a number of samples;

orthogonal conversion means for performing orthogonal conversion to said cut-out waveform data and producing orthogonally converted data therefrom; and phase detection means for detecting a phase information of respective higher harmonics components of said input signal waveform according to a real part and an imaginary part of said orthogonally converted data obtained by said orthogonal conversion step.

11. The audio coding apparatus as claimed in claim 10, wherein said input signal waveform is an audio signal.

12. The audio coding apparatus as claimed in claim 10, wherein said input signal waveform is a short-term prediction residual signal of an audio signal.

13. The audio coding apparatus as claimed in claim 10, wherein said cut-out waveform data from said waveform cut-out means is filled with zeroes to form $2^N$ samples fed to said orthogonal conversion means, wherein N is an integer, and $2^N$ is equal to or greater than said number of samples of said one-pitch cycle.

14. The audio coding apparatus as claimed in claim 10, wherein said orthogonal conversion means is a fast Fourier transform circuit.

15. The audio coding apparatus as claimed in claim 10, wherein said phase detection means uses said real part and said imaginary part of said orthogonally converted data from said orthogonal conversion means to calculate an inverse tangent ($\tan^{-1}$) to obtain a basic phase information and performs interpolation of said basic phase information to obtain said phase information of said respective higher harmonics.

16. An audio coding method for dividing an input signal waveform based on an audio signal into blocks on a time axis, obtaining a pitch for each of said blocks, and performing sinusoidal wave analysis-by-synthesis encoding on each of said blocks, said method comprising the steps of:

cutting out on a time axis a one-pitch cycle of said input signal waveform and producing cut-out waveform data, wherein said one-pitch cycle is comprised of a number of samples;

performing orthogonal conversion of said cut-out waveform data and producing orthogonally converted data therefrom; and detecting a phase information of respective higher harmonics components of said input signal waveform according to a real part and an imaginary part of said orthogonally converted data obtained by said orthogonal conversion step.

17. The audio coding method as claimed in claim 16, wherein said cut-out waveform data obtained in said waveform cut-out step is filled with zeroes to form $2^N$ samples, which are fed to said orthogonal conversion means, wherein N is an integer, and $2^N$ is equal to or greater than said number of samples of said one-pitch cycle.

18. The audio coding method as claimed in claim 16, wherein said phase detection step uses said real part and said imaginary part of the orthogonally converted data obtained by said orthogonal conversion step to calculate an inverse tangent ($\tan^{-1}$) to obtain a basic phase information, and performs interpolation of said basic phase information to obtain said phase information of said respective higher harmonics.

* * * * *